United States Patent [19]

Paulman et al.

[11] Patent Number: 4,794,985

[45] Date of Patent: Jan. 3, 1989

[54] FINNED HEAT EXCHANGER TUBING WITH VARYING WALL THICKNESS

[75] Inventors: Roger Paulman, Barrington; Franz X. Wohrstein, Park Ridge, both of Ill.

[73] Assignee: Peerless of America Incorporated, Chicago, Ill.

[21] Appl. No.: 43,942

[22] Filed: Apr. 29, 1987

[51] Int. Cl.[4] ..... F28D 1/00; F28D 1/32; F28F 1/30

[52] U.S. Cl. ..... 165/150; 165/172; 165/181; 165/179

[58] Field of Search ..... 165/181, 150, 172, 179

[56] References Cited

U.S. PATENT DOCUMENTS

| | | | |
|---|---|---|---|
| 785,081 | 3/1905 | Brinkman | 165/150 |
| 921,878 | 5/1909 | Nutting | 165/181 X |
| 3,202,212 | 7/1963 | Kritzer | 165/179 |
| 3,384,947 | 5/1968 | Anderson et al. | 29/157.3 |
| 3,537,516 | 11/1970 | Kunz | 165/181 |
| 3,692,105 | 9/1972 | O'Connor | 165/181 |
| 3,712,372 | 1/1973 | Tranel | 165/150 |
| 3,746,086 | 7/1973 | Pasternak | 165/181 |
| 3,850,236 | 11/1974 | O'Connor et al. | 165/181 |
| 3,866,286 | 2/1975 | Pasternak | 165/181 X |
| 3,877,517 | 4/1975 | Pasternak | 165/181 X |
| 3,886,639 | 6/1975 | Pasternak | 29/157.3 A |
| 3,901,312 | 8/1975 | Pasternak | 165/181 |
| 3,947,941 | 4/1976 | O'Connor et al. | 29/157.3 B |
| 4,203,311 | 5/1980 | O'Connor et al. | 72/254 |
| 4,298,062 | 11/1981 | Pasternak | 165/181 |
| 4,330,913 | 5/1982 | Kritzer | 29/157.3 A |
| 4,332,069 | 6/1982 | Kritzer | 29/157.3 A |
| 4,554,970 | 11/1985 | Pasternak et al. | 165/181 |
| 4,565,244 | 1/1986 | O'Connor et al. | 165/181 |
| 4,637,111 | 1/1987 | Pasternak et al. | 29/157.3 A |

FOREIGN PATENT DOCUMENTS

| | | | |
|---|---|---|---|
| 524493 | 4/1955 | Italy | 165/181 |

*Primary Examiner*—Ira S. Lazarus
*Assistant Examiner*—Richard R. Cole
*Attorney, Agent, or Firm*—Emrich & Dithmar

[57] ABSTRACT

A heat transfer unit includes an elongated finned tubular element bent in a serpentine pattern with the thickness of the wall of the tubular member made greater at return bend portions than at cross portions either by more shallow cutting of the rib material from which the fins are formed at the return bend portions than at the cross portions, or by crimping the tubular member at the return bend portions prior to cutting the fins so that a portion of the rib material from which the fins are cut is compressed inwardly on both sides of the tubular member to increase the wall thickness of tube material at the return bend portions.

7 Claims, 5 Drawing Sheets

FINNED HEAT EXCHANGER TUBING WITH VARYING WALL THICKNESS

BACKGROUND OF THE INVENTION

This invention relates to heat exchangers and methods of making the same, and more particularly to heat exchangers of the type embodying outwardly projecting fins and methods of making same.

Heat exchangers having heat transfer elements embodying fins formed from the outer surface material of tubular members are known in the art and have been disclosed example in U.S. Pat. No. 3,202,212 to Richard W. for Kritzer, U.S. Pat. No. 3,692,105 to Joseph M. O'Connor, and U.S. Pat. No. 4,554,970 to Stephen F. Pasternak and Franz X. Wohrstein. These prior art heat transfer elements are formed from a length of tubular stock, preferably one having a rectangular transverse cross-section and with one or more openings extending longitudinally of the element to carry a heat exchanger medium, such as water, or other coolants. The fins are formed in a skiving operation in which a cutting tool is passed longitudinally along the upper and lower surfaces of the tubular element, cutting or gouging the fins from longitudinally extending ribs provided on the surfaces of the tubular member.

In the Kritzer patent, the fins are in the form of spines formed from outwardly projecting ribs on the tubular member. In the O'Connor patent, fins are formed by cutting or gouging them from upwardly projecting ribs and the portion of the tubular member directly underlying the ribs, to thereby afford fins having elongated base portions projecting outwardly from the side wall of the tubular member, with spaced fins projecting outwardly from the outer longitudinal edges of the base portions. In the Pasternak et al patent, fins are cut or gouged from ribs on the sidewalls of the heat exchanger tubing by advancing a cutter into the ribs on the tubing. The position of the cutter is controlled to sever predetermined fins to provide predetermined fin-free areas on the sidewalls. This is accomplished by raising the cutter somewhat (in the order of three thousandths of an inch) toward the end of its forward stroke, defining fin severing stroked for forming the fin-free areas.

With present technology, the residual wall thickness for the tubing for these prior art units had to be in the order of 0.030 inches to 0.035 inches to provide the necessary strength in the heat exchanger tubing at return bend portions when the tube is bent into a serpentine pattern. Such wall thickness for the heat exchanger tubing was also required in the return bend portions for the heat exchanger tubing to withstand the considerable pressure forces present within the tube, particularly at the return bend portions which define the weak points of the heat exchanger assembly when it is in use. For these reasons, in heat exchanger units heretofore constructed, the dimensions of the tubing at the return bend portions dictated the dimensions of the heat exchanger tubing over its entire length.

Economic pressures exist to reduce the overall size and weight of heat exchanger units as well as the cost of such units. Thus, it would be desirable to have a heat exchanger unit of the fin type which is characterized by reduced overall weight as compared to a comparable size prior art heat exchanger unit and which requires less material for the heat exchanger tubing without compromising the strength of the heat exchanger tubing, particularly at the return bend portions thereof.

SUMMARY OF THE INVENTION

It is a primary object of the present invention to provide a novel heat exchanger of the fin type and a novel method of making such a heat exchanger.

It is another object of the invention to provide a novel heat exchanger of the fin type characterized by reduced overall weight as compared to a comparable size prior art heat exchanger unit.

Another object of the present invention is to provide a heat exchanger unit which requires less material than a comparable size prior art heat exchanger unit without compromising material strength particularly in return bend portions.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF PREFERRED EMBODIMENTS

Figure 1:
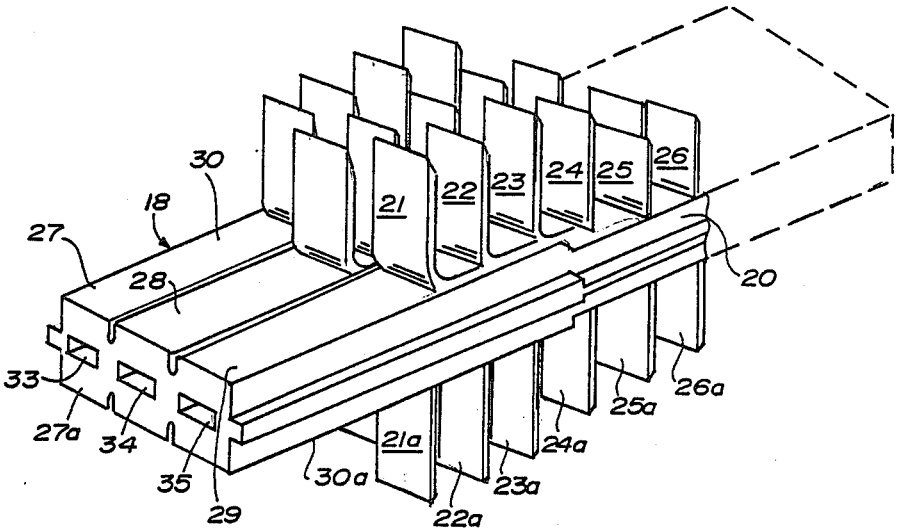
FIG. 1 is a perspective view of a length of heat exchanger element embodying the principles of the present invention.
Figure 2A:
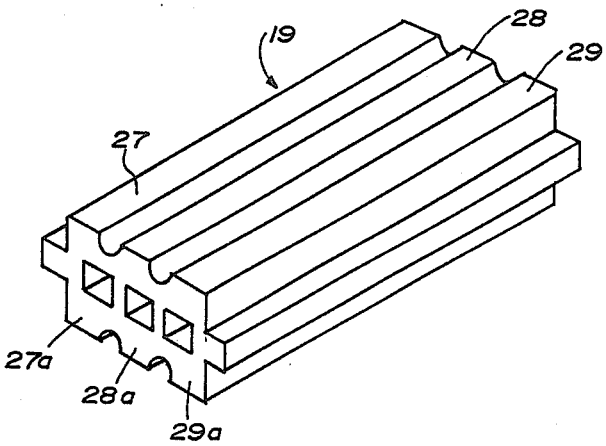
FIG. 2A is an enlarged perspective view of a portion of the extruded multi-port tubing shown in FIG. 2.
Figure 2:
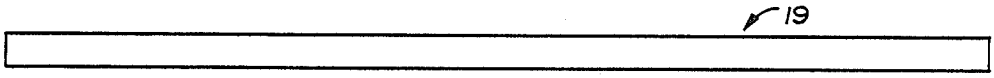
FIG. 2 illustrates a length of extruded multi-port tubing used in making the heat exchanger element of the present invention.

Referring to FIGS. 1 and 2, there is shown a heat exchanger or heat transfer element 18 for use in forming a heat exchanger unit according to one embodiment of the present invention. The heat exchanger element is shown as one end portion of an elongated tubular member 19. The heat exchanger element 18 embodies, in general, an elongated tubular body portion 20 having elongated fins 21-26 projecting outwardly, in rows, from elongated rib portions 27, 28, and 29 on the upper surface 30 of the tubular member 19. The rib portions 27–29 extend longitudinally of the tubular member 19 in parallel spaced relation to one another. Similarly, a second plurality of fins 21*a*–26*a* depend downwardly from the lower surface 30*a* of the tubular member 19 from rib portions 27*a*, 28*a* and 29*a* on the lower surface 30*a* of the tubular member. The heat exchanger element 18 is symmetrical about a plane drawn through its longitudinal axis. Thus, the second group of fins 21*a*–26*a* is a mirror image of the fins 21–26 formed on the upper surface of the tubular member 19.

Referring to FIGS. 1, 2 and 2A, the heat exchanger element 18 is preferably formed from a suitable length of tubular stock shown in FIGS. 2 and 2A, which may be a multi-port extruded tubular member of aluminum or other suitable heat conducting material. The tubular member 19 includes three openings or passageways 33, 34 and 35 which extend longitudinally through the tubular member 19. The upper surface 30 of the tubular element 19 has outwardly projecting rib portions 27, 28 and 29 from which the fins 21–26 are formed by a skiving process in a manner to be described. Similarly, the lower surface 30*a* of the tubular member 19 has outwardly projecting rib portions 27*a*, 28*a* and 29*a* from which the fins 21*a*–26*a* are formed. The shape of the free end or projecting portion of the fins is determined by the shape or configuration of the rib portions. Thus, the fins may be straight edged, curved edged, apertured, etc., as determined by the configuration of the rib portions.

Figure 7:
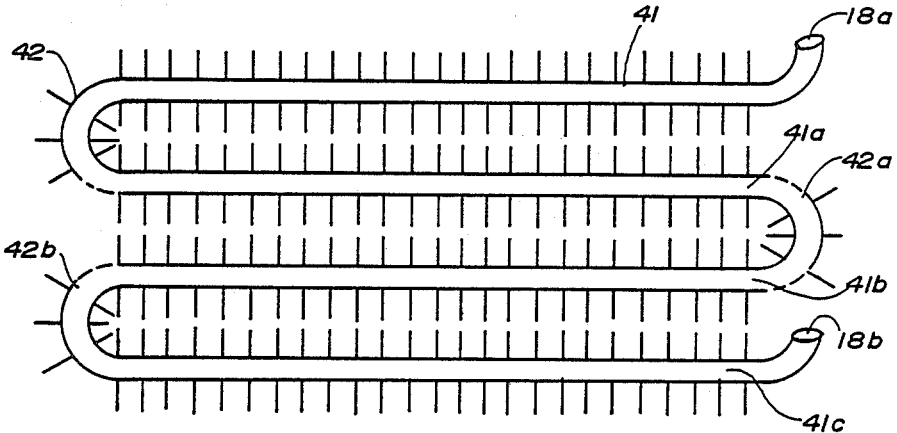
FIG. 7 is a simplified representation of the heat exchanger element shown bent in a serpentine pattern to form a heat exchanger unit.

Finned heat exchangers of this type are generally made in substantial lengths, such as for example, 30, 40 or 50 foot lengths. After the fins have been formed, the tubing is bent, typically in a serpentine pattern, as shown in FIG. 7, to provide a more compact configuration for the heat exchanger unit. After bending, the heat exchanger element 18 defines a heat exchanger unit having a plurality of parallel extending pass or cross portions 41, 41*a*, 41*b*, etc., interconnected by return bend portions 42, 42*a*, 42*b*, etc., at opposite ends.

Figure 3:
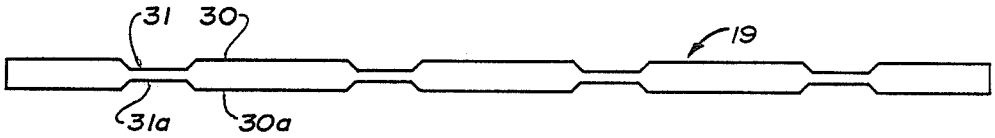
FIG. 3 illustrates the extruded multi-port tubing of FIG. 2 compressed at areas along its longitudinal length.
Figure 4:
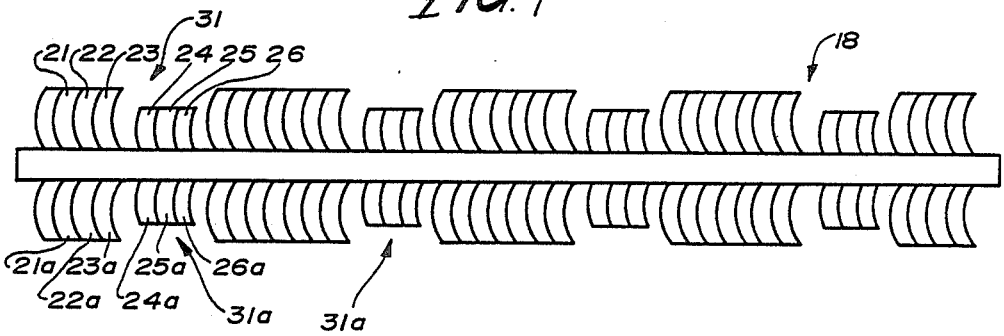
FIG. 4 illustrates the extruded multi-port tubing of FIG. 3 provided with fins in accordance with one embodiment of the present invention.

In accordance with the invention, the tubular member 19 used for forming a heat exchanger unit has a wall thickness of approximately 0.020 inches or less, or about 0.010 inches less than that possible for comparable prior art heat exchanger units. This is achieved in accordance with the invention by controlling the manner in which fins are cut in the return bend portions of the heat exchanger element in such a way as to provide at return bend portions an effective wall thickness of about 0.030 to 0.035 for the heat exchanger element, the additional 0.010 to 0.015 inch wall thickness being provided by the rib material from which the fins are cut. Thus, in forming the heat exchanger element 18, portions 31 and 31*a* of the upper and lower surfaces 30 and 30*a*, respectively, of the tubular member 19 are compressed slightly prior to cutting the fins. As shown in FIGS. 3 and 4, fins 21–23 are longer in vertical extent than fins 24–26 because rib portions from which the fins 24–26 and 24*a*–26*a* are cut are thinner due to the compression of the tubular member in return bend areas. These compressed surface portions 31 and 31*a* are provided in the area of return bends of the heat exchanger element 18 and provide increased wall thickness in such areas by having a portion of the rib material, about 0.010 to 0.015 inches thick, pushed inwardly on both the upper and lower surfaces 30 and 30*a* of the tubing for a length equal to the return bend lineal space. This results in a residual wall thickness in the return bend portion preferably at least approximately 0.030 inches to 0.035 inches in thickness which is greater than the 0.020 to 0.025 inch thickness for the pass portions of the tubing.

Figure 5:
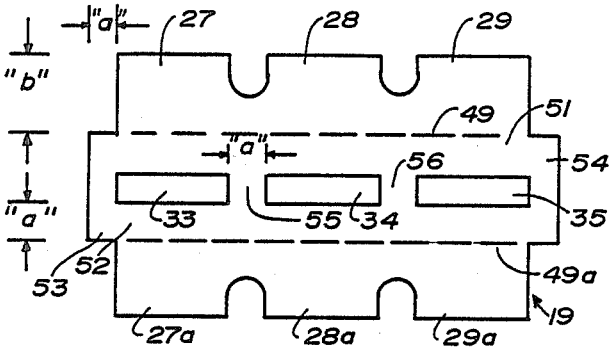
FIG. 5 is a sectional view taken along the line 5-5 of FIG. 4.

Referring to FIG. 5, the extruded multi-port member has an upper wall portion 51, a lower wall portion 52, and side walls 53 and 54. Two intermediate walls 55 and 56 extend vertically between the upper and lower wall portions 51 and 52 and divide the center portion of the tubular member into three channels, defining the three openings 33–35 through the tubular member. In one heat exchanger element which was constructed, the thicknesses "a" of the wall portions 51–56 in the extruded multi-port tubular member 19 are 0.020 inches. The thicknesses "b" of the rib portions 27–29 (and 27*a*–29*a*), prior to skiving, are 0.065 inches. Cutting lines 49 and 49*a*, represented by dashed lines in FIG. 5, indicate the depth to which the ribs 27–29 and 27*a*–29*a* are cut to form the fins 21–26 and 21*a*–26*a* during the skiving process.

Figure 6:
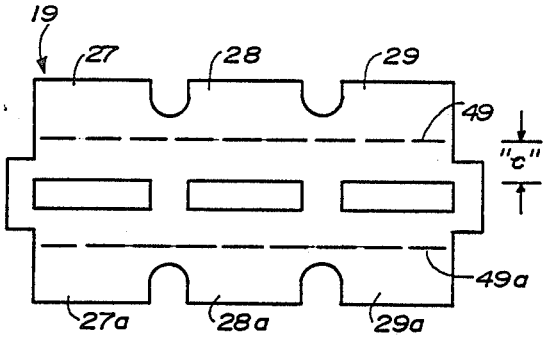
FIG. 6 is a sectional view taken along the line 6—6 of FIG. 4.

Referring to FIGS. 3 and 6, in the compressed portions 31 and 31*a*, which form the return bend portions 42, 42*a*, 42*b*, 42*c* of the heat exchanger element 18, the upper and lower surfaces of the tubular member 19 have been "compressed" into the center portion of the tubing by an amount in the order of 0.010 to 0.015 inches and preferably about 0.010 inches, so that the cutting lines 49 and 49*a* are located outwardly from the center of the tubular member 19 a distance so as to define a wall portion having an effective thickness "c" of about 0.030 to 0.035 inches and preferably about 0.030 inches for the return bend areas 42, 42*a*, 42*b*, 42*c*, etc. Compressing a portion of the rib material 27–29, 27*a*–29*a*, inwardly from both the top and bottom surfaces 30 and 30*a* of the tubular member 19 in the return bend areas 31, 31*a* results in slightly shorter fins in the return bend area, as illustrated in FIGS. 1 and 4. However, this is of no consequence because the fins are not effective in the return bend areas.

As will be appreciated by those skilled in the art, the tubular member 19 shown as having a rectangular cross-section and having plurality openings extending therethrough, is merely by way of illustration and not by way of limitation. Tubular members having shapes other than rectangular and having fewer or more than three openings extending longitudinally therethrough may be provided without departing from the scope from the present invention.

Referring now to FIGS. 2, 2A and 3, in making the heat exchanger element 18, a tubular member, such as tubular member 19 and embodying the rib portions 27–29 and **27*a*'–29*a*' extending the full length thereof, is first formed by an extrusion process or in any other suitable manner. The length of extruded multi-port tubular stock 19, FIG. 2, is then compressed for a length equal to the return bend lineal space as at areas 31 and 31*a* shown in FIG. 3**.

The tubular element 19 is compressed at the return bend portions by a crimping apparatus 60, shown by way of example, as part of the skiving apparatus used to cut the fins in the tubular member. The crimping apparatus 60, shown in FIG. 10 mounted on one end of a guide 65 for the tubular member, includes a pair of jaws 61 and 62, shown in FIG. 10A, having center channels **61*a*, 62*a*, shaped to receive the tubular member shown in dashed lines in FIG. 10A, with its ribbed center portion 19' located in the channels 61*a*, 62*a* and with its flange-like side portions 19'' located between opposing raised end walls 61*b*, 62*b*. The jaws 61 and 62 are driven toward one another, by a suitable drive mechanism (not shown), compressing the portion of the tubular member located therebetween, to define the return bend portions of reduced outer diameter as shown in FIG. 6. The operation of the crimping apparatus 60 is synchronized with that of the cutting apparatus to form the compressed areas on the tubing element at each of the return bend areas, automatically, as the tubing is advanced through the guide 65** to the cutting apparatus.

After the return bend portions 42, **42*a*, 42*b*, 42*c*, etc., have been defined o the extruded multi-port tubular member 19, the fins 21–26, 21*a*–26*a***, are formed using a skiving process by apparatus known in the art.

Figure 10:
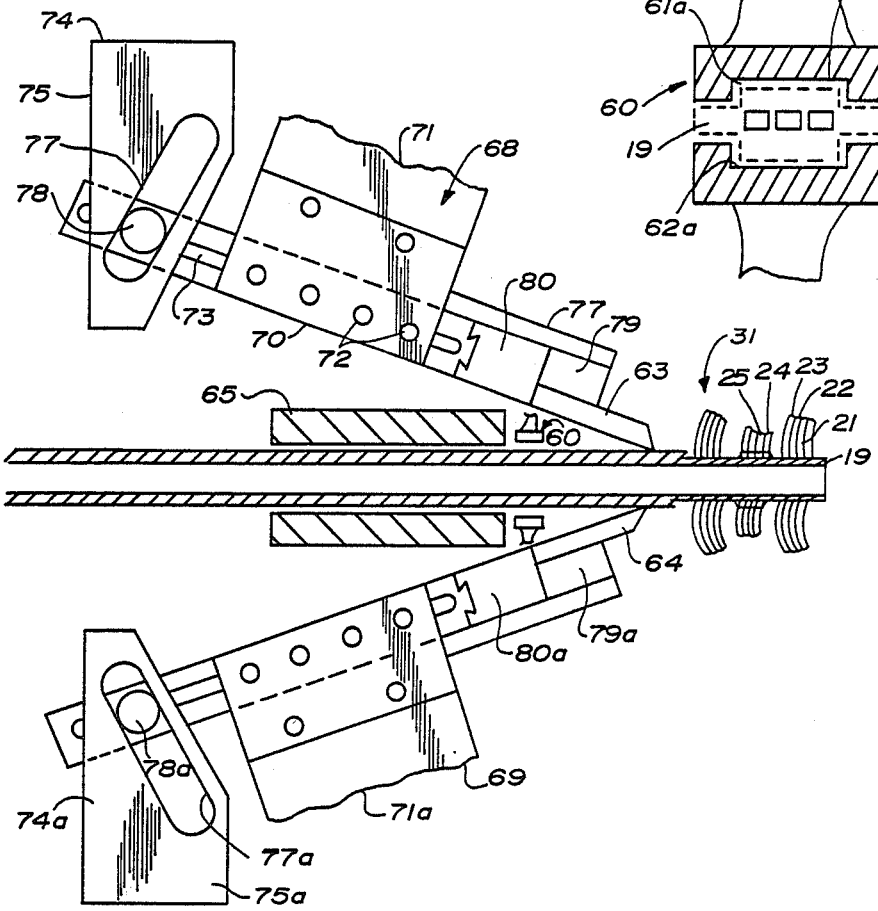
FIGS. 10 and 10A are a somewhat diagramatic showing of apparatus adapted for producing the heat exchanger elements including cutting fins on the extruded multi-port element illustrated in FIG. 3.
Figure 10A:
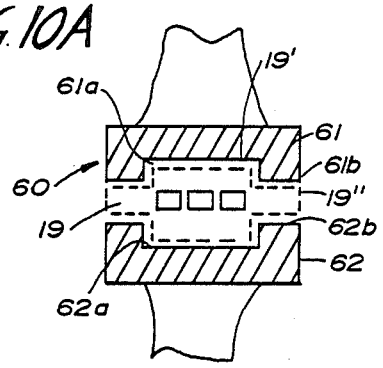

Referring to FIG. 10, in making fin type heat exchanger thus far described, the fins are cut or gouged from the rib material at opposite sides of the tubular member 19 by apparatus of the type known in the art, and may be similar to that shown, for example, in Richard W. Kritzer U.S. Pat. No. 4,330,913. However, the apparatus is controlled in a manner to be described to provide the particular fin configuration and length in the cross or pass portions and in the return bend portions.

Referring to FIG. 10, the apparatus includes two cutter bars 63 and 64 each of which is operatively connected to a suitable mechanism 68 and 69 for forming the fins in accordance with the principles of the present invention.

Preferably the width of the cutter bars 63 and 64 corresponds to the width of the tubular member (FIG. 5) to enable fins to be cut from all three rib portions at the same time. However, each cutter bar may comprise three separate cutters, which may be fixed or adjustable, to provide fins aligned in rows, or staggered relative to one another. Also, a single cutter can be used, and moved sidewise across the lateral extent of the tubular member as well as along its longitudinal extent, as is known in the art. The mechanisms 68 and 69 are identical in construction except that they are mirror images of each other and, therefore, parts of the mechanism 69 which are identical to corresponding parts of mechanism 68 are indicated in the drawings with a same reference numerals as the corresponding parts of the mechanism 68, but with the suffix "a" added thereto.

The mechanism 68, FIG. 10, which operates on the upper surface 30 of the tubular member, embodies an elongated substantially rectangular-shaped cutter slide 70 slidably mounted on the bottom portion of a substantially inverted U-shaped stationarily mounted cutter guide 71 for longitudinal reciprocation therethrough. The cutter guide 71 has a plurality of pins 72 mounted on the opposite side walls thereof and projecting into the elongated grooves 73 formed in the respective opposite sides of the cutter slide 70 and extending the length thereof for mounting the slide 70 in the cutter guide 17.

The mechanism 68 also includes a substantially inverted U-shaped cross-head 74 movably mounted therein for vertical reciprocation relative to the cutter slide 70. The cross-head 74 embodies two vertically extending side walls, only one of which is shown and given the reference number 75, disposed on opposite sides of the slide 70, the side walls each having cam slots 77 disposed therein, only the cam slot 77 in side wall 75 being shown in the drawing. Pins 78, only one of which is shown in the drawings, are mounted in the opposite sides of the slide 70 and project outwardly through respective ones of the cam slots 77 in such position that vertical reciprocation of the cross-head 74 is effective to reciprocate slide 70 longitudinally through the guide 71 by reason of the engagement of the pins 78 with the side walls of the cam slots 77.

The apparatus, further includes a guide 65 for the tubular member 19 for longitudinal movement of the tubular member 19 therethrough. The guide 65 is disposed in position to effectively support the tubular member 19 is position for the aforementioned cutting or gouging operations of the cutter bar 63 on tubular member 19.

The operational mechanism 69 is the same as that for mechanism 68 except that mechanism 69 is disposed below the tubular member 19 and operates on the lower surface **30*a*** thereof.

In the skiving operation for the embodiment of the heat exchanger element 18 shown in FIG. 1, the length of the stroke of the cutter bars 63 and 64 is the same for the fins 21–23, **21*a*–23*a* and for the fins 24–26, 24*a*–26*a* in the return bend portions in the pass or cross portions of the heat exchanger element. However, because the upper and lower surfaces of the tubular element 19 are compressed in the regions 31, 31*a*** which define the return bend portions in the longitudinal tubular member, slightly shorter fins occur at the reduced bend return areas.

Figure 8:
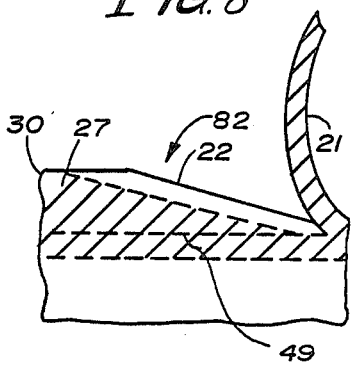
FIGS. 8 and 9 are enlarged sectional views illustrating how different length fins are produced at the heat exchanger pass portions and return bend portions, respectively.
Figure 9:
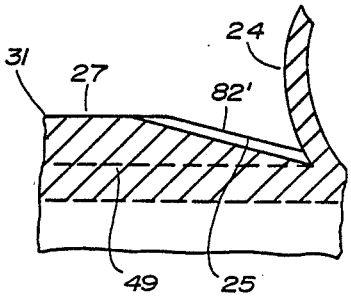

This is illustrated in FIGS. 8 and 9. FIG. 8 illustrates a fin 21 cut from a rib 27, and dashed line 82 defines the path of travel of the cutter bar in cutting the next fin 22. Dashed line 49 represents the cutting line. FIG. 9 illustrates a fin 24 cut from a compressed portion of rib 27, and dashed line 82' defines the path of travel of the cutter bar is cutting the next fin 25. Because the depth of rib material above cutting line 49 is less for the compressed rib area (FIG. 9) than for the uncompressed rib area (FIG. 8), the fins 24, 25 etc. are shorter than fins 21, 22 etc.

After the fins 21–26, 21a–26a have been cut for the entire length of the tubular member, the tubular member 24 is bent in a serpentine fashion to form the heat exchanger unit as illustrated in FIG. 7, which has an inlet 18a and an outlet 18b located at the same end of the heat exchanger unit for connection to a source of coolant.

Figure 11:
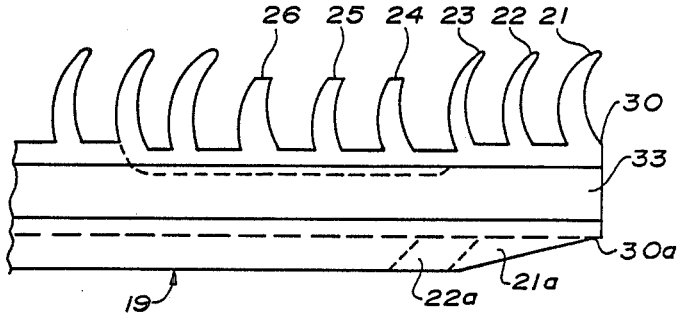
FIG. 11 is a fragmentary view of a portion of the heat exchanger tubing provided by the present invention, illustrating the fins produced in the pass portions and return bend portions thereof.

Referring to FIG. 11, in one heat exchanger element 18 which was constructed, the height of the fins 21–23 (and 21a–23a) in the cross portions of the heat exchanger element 18 is 0.441 inches and the height of the fins 24–26 (and 24a–26a) in the return bend areas is 0.340 inches. The thickness of the fins in the cross portions and the return bend portions is 0.0085 inches. In this embodiment, wherein the rib portions are 0.065 inches thick prior to skiving, the length of the stroke made by the cutting blades 63 and 64 is 1.169 inches at a cutting angle of 3° relative to the longitudinal axis of the tube. Each return bend portion is three inches in length and contains forty-eight fins, 16 fins per inch.

Figure 12:
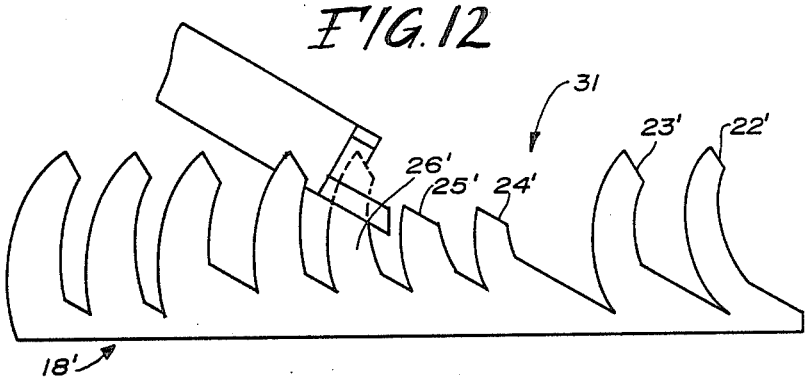
FIG. 12 is similar to FIG. 9 but illustrates the fins formed in the return bend portions being cut off.
Figure 13:
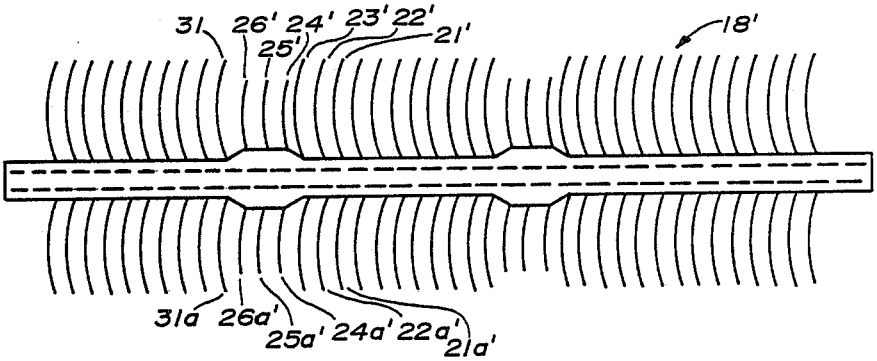
FIG. 13 illustrates a finned heat exchanger element for forming a heat exchanger unit provided in accordance with a second embodiment of the invention.

Referring to FIGS. 12–13, there is illustrated a simplified representation of a heat exchanger element 18' provided in accordance with a second embodiment of the invention. In this embodiment, the increased residual thickness in the wall of the return bend portions is provided by changing the depth of cut of the fins 24'–26', 24a'–26a' in the area of the return bends relative to that for fins 21'–23', 21a'–23a' in the "cross" element areas during the skiving operation. As illustrated in FIG. 13, in the return bend portions 31 and 31a, rib portions which are of a thickness of 0,065 inches are cut to a depth 0.010 inches less than for the rib portions which are cut to provide the fins at the "cross" section areas. Thus, for a tubular element having an inner wall thickness of about 0.020 to 0.025 inches, the effective wall thickness in the return bend portions 31 and 31a is about 0.030 to 0.035 inches.

Referring to FIG. 12, because fins are not effective in the return bend areas, the upper portions, of the fins 24–26 may be cut off as illustrated in FIG. 12 using a separate cutting operation as is known in the art.

The depth of cut is raised at the return bend portions at both the upper and lower surfaces of the tubular element 19 by adjusting the length of the cam stroke of the cutter bars 63 and 64 of the apparatus shown in FIG. 10, which can be used to form the fins 21'–26' and 21a'–26a'. This is done, for example, by limiting the vertical stroke of the member 74 or limiting the travel of the cam 78 shown in FIG. 10. For example, the stroke of the cutter bar is limited to the two positions required to cut the "cross" fins 21'–23', 21a'–23a' and the return bend fins 24'–26', 24a'–26a'. The cutting apparatus (FIG. 10) is programmed to sequence all the return bend locations as required.

Alternatively, the depth of the cut provided in the return bend areas 31 and 31a. may be adjusted by changing the path of travel of the cutter bars 63 and 64 (FIG. 10) by controlling the hydraulics which drive the reciprocating member 74 up and down. Thus, the stroke can be maintained constant by moving the cutting assembly relative to the tubular member.

Figure 14:
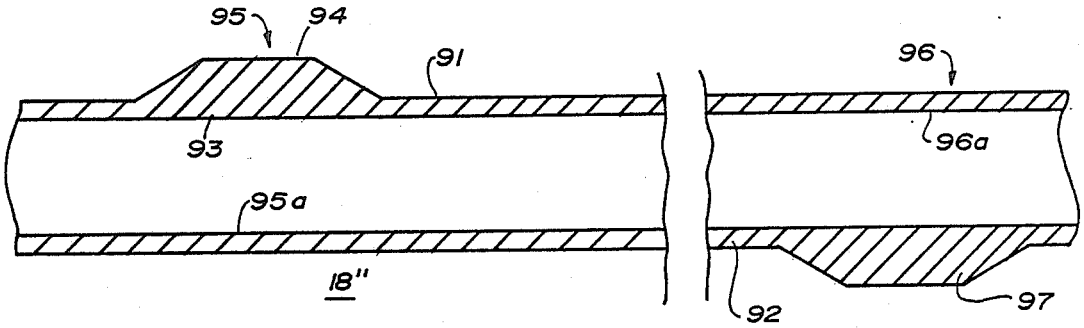
FIG. 14 illustrates an extruded multi-port tubing, prior to skiving, for use in producing a heat exchanger unit in accordance with a further embodiment of the invention.
Figure 15:
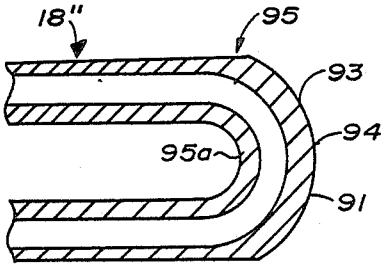
FIG. 15 is an enlarged sectional view of a return bend portion of the tubing of the heat exchanger element of FIG. 14.
Figure 16:
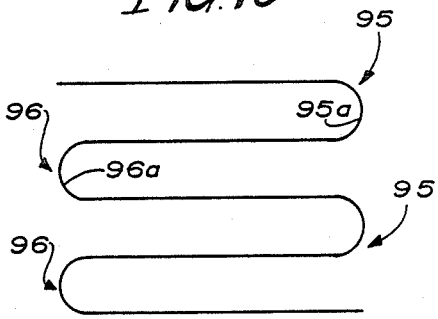
FIG. 16 is a simplified representation of the heat exchanger tubing shown in FIG. 14, illustrating the relationship of the increased inner wall areas of the tubing on opposite bends.

Referring to FIGS. 14–16, there is shown a further embodiment for an extruded multi-port heat exchanger element 18" in which the width of the tubing at one side thereof in the return bend portion 95 is increased alternately on the upper surface 91 and lower surface 92. The thickened wall portion 93 of the return bend is located at the tension side 94 or outer surface when the heat exchanger tubing is bent into the serpentine pattern to form the completed heat exchanger unit. As shown in FIG. 14, the upper surface 91 of the tubular member has return bend portion 95 of an increased thickness, and at the complementary return bend portion indicated at 96, the lower surface of the tube has an increased wall thickness. It is possible to provide the opposing side walls at points 95a and 96a with a thinner wall portion at the compression side of the heat exchanger tubing formed when the tubing has been bent in serpentine fashion.

In the embodiment for the heat exchanger element 18" shown in FIG. 14, the length of the stroke of the cutting bar is maintained constant as the fins are cut, but the cutting tools are raised to a height of about 0.010 to 0.015 inches and preferably about 0.010 inches for cutting fins in the return bend areas 95 and 96.

Figure 17:
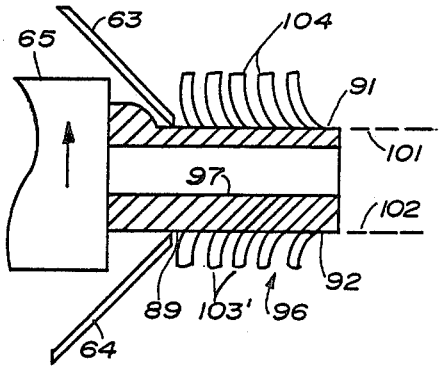
FIGS. 17 and 17A are simplified representations of apparatus for producing a heat exchanger element in accordance with a further embodiment of the invention.
Figure 17A:
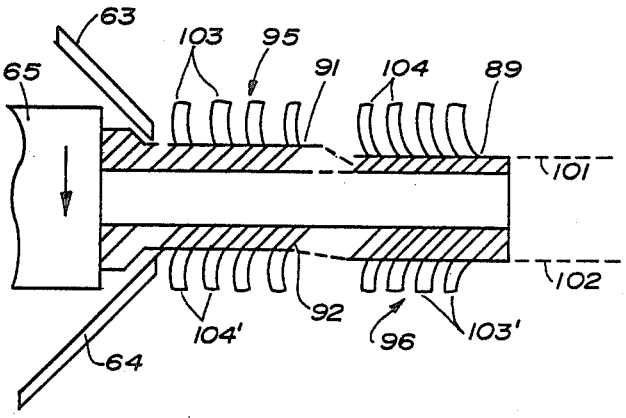

The same affect can be achieved by moving the workpiece relative to the cutting tools. Referring to FIGS. 17 and 17A, skiving apparatus, similar to that shown in FIG. 10, for cutting fins on a length of multiport tubing 89 includes a guide 65 and a pair of cutting tools 63 and 64 which are disposed on opposite sides of the tubing 89. In this embodiment, the cutting tools 63 and 64 are driven toward and away from respective surfaces 91 and 92 of the tubing as the tubing is advanced through the guide 65, the cutting tools 63 and 64 being advanced with the length of the cutting stroke being maintained constant, as the cutting tools are driven between a retracted position and an extended position whereat the tips of the cutting tools reach respective cutting lines 101 and 102. In this embodiment, the workpiece 89 is moved up and down relative to the cutting tools 63 and 64, at the return bend areas, such as areas 95 and 96 (FIG. 17A), to cut deeper on one side and more shallow on the opposite side. For example, with reference to FIG. 17, in forming the thicker wall portion 97 at return bend 96, the workpiece is positioned upward relative to the cutting tools 63 and 64 so that cutting tool 63 cuts deeper into the upper surface 91 of the tubing and cutting tool 64 cuts less deeply into the lower surface 92 of the tubing. In forming the thicker wall portion 93 at return bend 95, the workpiece is positioned downward relative to the cutting tools 63 and 64 so that cutting tool 63 cuts less deeply into the upper surface 91 of the tubing and cutting tool 64 cuts more deeply into the lower surface 92 of the tubing. At pass portion, the workpiece is positioned intermediate these two positions. Thus, in forming the fins at the return bend areas, such as areas 95 and 96, the workpiece is moved downwardly, in forming return bend 95, and upwardly, in forming return bend 96, relative to the cutting tools which continue to be driven, to an extended position at which their tips reach the cutting lines 101 and 102, respectively. Thus, a thicker wall portion 93, and shorter fins 103, are produced at return bend 95, at the upper surface 91 relative to the lower surface 92. Similarly, at the complementary return bend area 96, a thicker wall portion 97 and shorter fins 103' are produced at the lower surface 92 relative to the upper surface. By selection of the tubing and the amount of vertical movement of the workpiece, a heavier wall, in the order of 0.030 inches can be provided on the compression side of the bend with a wall thickness in the order of 0.020 inches on the opposite, tension side, for a given return bend area.

What is claimed is:

1. A heat exchanger unit comprising:

an elongated one-piece tubular member generally rectangular in shape and having an upper wall, a lower wall, and first and second side walls, at least one passageway through said tubular member between first and second ends thereof;

said one-piece tubular member being bent to define a plurality of pass portions and a plurality of return bend portions integral with said pass portions, with each return bend portion interconnecting a pair of adjacent pass portions at the ends thereof, at least two groups of fins formed integrally with said tubular member, said groups of fins being spaced from each other longitudinally along at least said upper wall on the outer surface thereof and projecting outwardly from said tubular member;

said first group of fine being provided at said return bend portions and said second group of fins being provided at said pass portions; and the thickness of at least said upper wall at said return bend portions being greater than the thickness of said upper wall portions at said pass portions, and the fins in the return bend portion being shorter than the fins in the pass portions.

2. A heat exchanger unit according to claim 1, wherein said tubular member is bent in a serpentine configuration including a plurality of pass portions extending parallel to one another.

3. A heat exchanger element according to claim 1, wherein said tubular member includes a further two groups of fins formed integrally with said tubular member, said further groups of fins being spaced from each other longitudinally along said lower wall on the outer surface thereof including a group of fins provided at said return bend portions and a further group of fins provided at pass portions on said lower wall of said tubular member, the thickness of said lower wall at said return bend portions being greater than the thickness of said lower wall portions at said pass portions, and the fins at the return bend portions being shorter than the fins at the pass portions.

4. A heat exchanger unit according to claim 1, wherein the thickness of at least said upper wall at said return bend portions is in the range of about 0.030 inches to 0.035 inches, and the thickness of at least said upper wall in said pass portions is in the range of about 0.020 inches to 0.025 inches.

5. A heat exchanger unit comprising:

an elongated tubular member generally rectangular in shape and having an upper wall, a lower wall, and first and second side walls, said tubular member defining a rib portion on the outer surface of its upper wall, at least one passageway through said tubular member between first and second ends thereof;

said tubular member bent to define a plurality of pass portions and a plurality of integral return bend portions, each interconnecting a pair of adjacent pass portions at the ends thereof, at least two groups of fins spaced from each other longitudinally along at least said upper wall on the outer surface thereof and projecting outwardly from said tubular member;

said first group of fins being provided at said return bend portions and said second group of fins being provided at said pass portions;

said fins of said first and second groups being cut from said rib portion, and the depth of cut of said rib portion at said return bend portions being more shallow than the depth of cut of said rib portion at pass portions whereby the thickness of at least said upper wall at said return bend portions is greater than the thickness of said upper wall portions at said pass portions.

6. A heat exchanger unit according to claim 5, wherein the base of the rib portion at said return bend portions is located beneath a cutting line extending through the base of the fin of the rib portions at said pass portions whereby the thickness of said upper wall at said return bend portions is increased by an amount corresponding to the thickness of the base of said rib portion located beneath the cutting line.

7. A heat exchanger unit according to claim 5, wherein a cutting line for said first group of fins lies in a plane disposed outwardly from a plane drawn through a cutting line for said fins of said second group.

* * * * *